United States Patent [19]

Lough

[11] Patent Number: 4,934,085

[45] Date of Patent: Jun. 19, 1990

[54] NIGHT SIGHT MOUNTING BRACKET FOR ROCKET LAUNCHER

[75] Inventor: Lewis E. Lough, Woodbridge, Va.

[73] Assignee: The United States of America as represented by the Secretary of the Army, Washington, D.C.

[21] Appl. No.: 453,884

[22] Filed: Dec. 20, 1989

[51] Int. Cl.[5] ..... F41G 1/38; F41G 1/32

[52] U.S. Cl. ..... 42/100; 42/101; 42/103; 33/250

[58] Field of Search ..... 42/101, 103, 102, 100; 33/244, 254, 255, 241, 250, 235; 362/110; 89/41.17

[56] References Cited

U.S. PATENT DOCUMENTS

| | | | |
|---|---|---|---|
| 3,984,916 | 10/1976 | Newcomb et al. | 33/254 |
| 4,383,371 | 5/1983 | Coffey | 42/101 |
| 4,742,636 | 5/1988 | Swan | 42/101 |

FOREIGN PATENT DOCUMENTS

| | | | |
|---|---|---|---|
| 0079549 | 11/1962 | France | 42/100 |

*Primary Examiner*—Charles T. Jordan
*Assistant Examiner*—Michael J. Carone
*Attorney, Agent, or Firm*—Milton W. Lee; John E. Holford; Anthony T. Lane

[57] ABSTRACT

The invention provides a bracket to mount a standardized nightsight to a standardized anti-armor rocket launcher which requires no modification of either standardized item.

3 Claims, 1 Drawing Sheet

NIGHT SIGHT MOUNTING BRACKET FOR ROCKET LAUNCHER

The invention described herein may be manufactured, used, and licensed by the U.S. Government for governmental purposes without the payment of any royalties thereon.

BACKGROUND OF INVENTION

1. Field

The invention applies to anti-armor rocket launching systems and particularly to optical sights therefor.

2. Prior Art

Current sights on anti-armor weapons such as the Army's AT4 shoulder held rocket launching system are designed for daytime use only. These sights consist of front and rear upstanding metal leaves of fairly intricate shape which fold flat against the launching tube of the AT4 when not in use. To protect these leaves when folded a longitudinally disposed and grooved metal rail is mounted on the tube at each side of each sight. A separate rigid cover slides over the rails at each sight, moving along the grooves until the rear edge of the cover abuts the rear end of the rails and the front edge snaps over the front edge of the rails. Since the weapon is useful only at rather short ranges no provision has been made for telescopic and other more sophisticated sights. It has recently been determined that weapons like the AT4 would be equally effective at night, if equipped with a night sight such as the Armys PVS-4, but as indicated, no provision has been made for mounting such units. An object of the present invention is to provide a simple adaptor to provide such a mounting without having to alter the configuration of the weapon or the sight.

SUMMARY OF THE INVENTION

The novel adaptor consists of a housing portion which resembles the cover for the rear sight and engages the cover rails to protect the daysight. The housing portion is also integrally attached to a flange portion which in turn engages the mounting foot of the sight. Separate clamping means are provided on both portions to prevent linear or angular displacement between the weapon and sight after mounting to preserve a built-in boresighted relationship.

BRIEF DESCRIPTION OF THE DRAWING

The invention is best understood with reference to the drawing wherein there is shown the smooth bore launching tube of the anti-armor weapon including the cover track assembly for the rear sight, applicants novel adaptor and the more sophisticated sight which has been added.

DESCRIPTION OF THE PREFERRED EMBODIMENT

Figure 1:
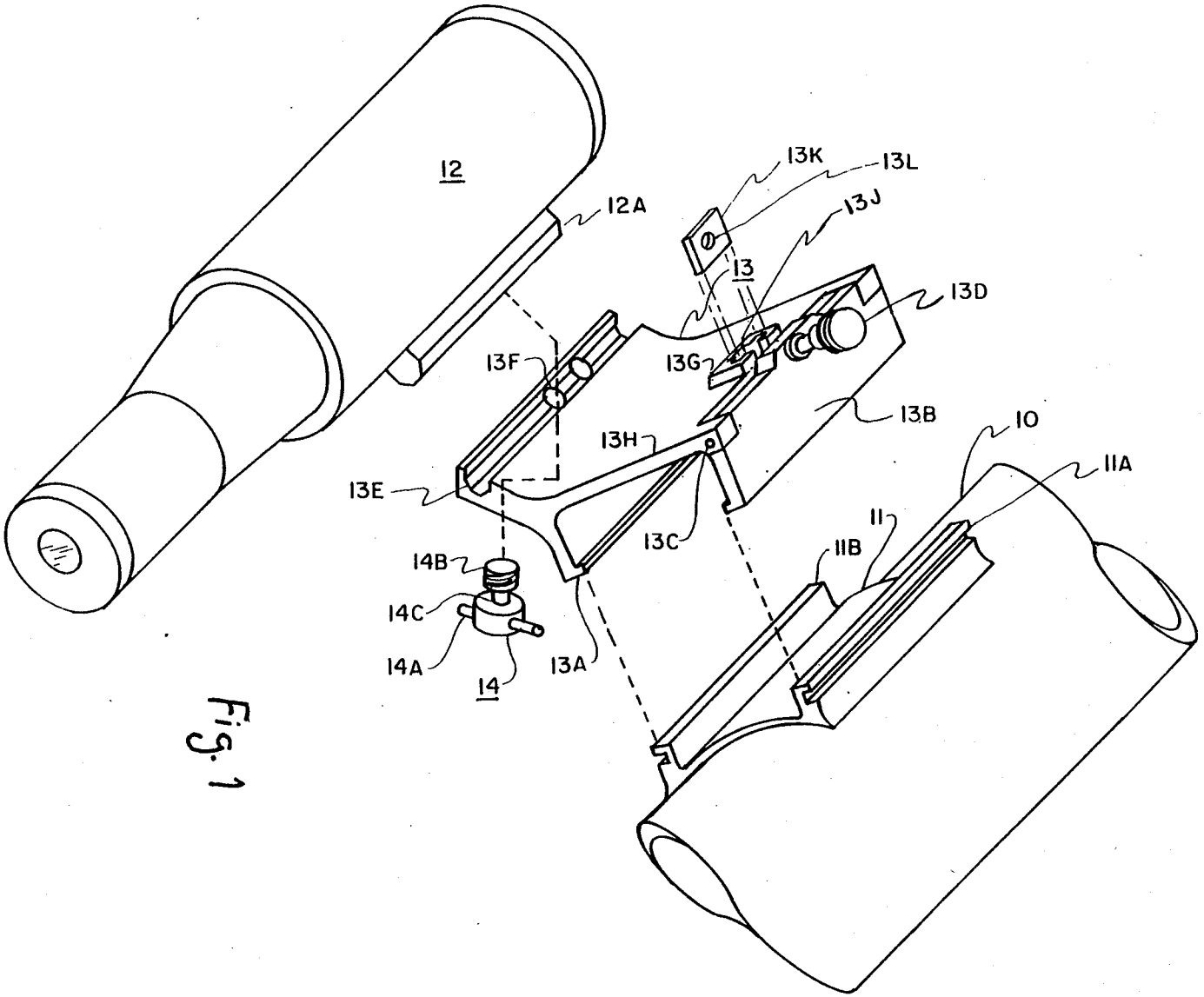

As shown in the drawing the Army's anti-armor weapon AT4 consists mainly of a smooth bore firing tube 10 on which is mounted a pair of cover rail assemblies such as the rear peep sight assembly 11. The rails 11A and 11B of the rear assembly run parallel to axis of the tube. Each rail defines a groove in its outermost side face to engage a cover (not shown). A hinged or folding day sight (not shown) is mounted at one end of each assembly and lies between the rails when folded.

The Army's nightsight 12 (e.g. AN-PVS-4), which has the capability of turning the AT4 and similar weapons into a night attack system has a bar shaped mounting foot which extends along its exterior surface parallel to the optical axis of the sight. The cross-section of the foot is rectangular with chamfered lower corners to facilitate its placement in a sight mounting groove provided on a number of existing weapon systems. The bottom of the foot, between chamfered edges is drilled and tapped for mounting screws. Unfortunately no such sight mounting groove is present on the AT4 type system.

To overcome this deficiency applicant provides a novel adaptor bracket 13. The bracket has a generally channel shaped cross-section with down standing legs 13A and 13B. The lower ends of legs extend toward one another providing wide feet that engage grooves 11A and 11B. The edges of the feet may be tapered and/or chamfered to permit quick attachment of the bracket to the weapon. In order to provide a firm engagement between the feet and the rail grooves, and to prevent angular and linear displacements; the end of one leg remote from the foot is hinged by a pair of pivots, such as pivot 13C. A clamping screw 13D is threaded normally through the leg so that the axis of the pivots lies between this screw and the foot. A threaded steel insert 13K may support the screw in the softer aluminum leg material. The end of the screw when rotated clockwise engages a rectangular leaf spring 13J, inserted in grooves defined by a boss 13G on the top portion 13H of the bracket, thus forcing the foot firmly into the rail grooves. The clamping screw may simply press against the center of the spring, but it is preferred that the end of screw be attached loosely to this center. This may involve forming a hole 13L in the spring's center, projecting a reduced diameter end portion of the clamping screw through the hole, and swaging this end portion enough to capture the screw without inhibiting its rotation.

The bracket also has a projecting flange 13E that defines a groove for the bar shaped foot 12A on the night sight 12. It is important for bore sighting that the grooves defined by rails 11A and 11B, the feet on the bracket, the groove in flange 13E, and the foot 12A be closely parallel to one another and to the axis of the weapon tube and the sight. The flange projects from a corner formed between the top portion of the bracket and the rigid leg to provide a very stable structure. One or more mounting holes 13F are provided in the flange 13E through the mounting groove, to mate with similar threaded holes present in the mounting rail 12A of the sight. A thumb screw connection means 14 with the usual leverage device 14A is fitted through each mounting hole and is provided with a threaded portion 14B to engage the threads in mounting rail 12A and lock it to the bracket. An undercut neck portion 14C is provided below the threaded portion 14B slightly longer than the thickness of the flange 13E at the bottom of its groove. By similarly threading the holes in the flange, the screws will be captured once threaded through the flange and not easily misplaced. The size of holes 13F and screw 14 are exaggerated for clarity, their actual diameter not exceeding the width of the flat bottom face of the foot.

The angle between the flange and top portion of the bracket is chosen to plumb the vertical cross hair in the night sight. The width of the flange is held to a minimum which permits access to the battery receptical on the night sight, the cover of which faces the launch tube 10. This provides close bore sighting between the weapon tube and the optical axis of the sight and a more stable overall structure. With the AT4 weapon, quick attachment and removal is a major advantage. The weapon is issued as a round, with a rocket and firing assembly factory installed and the tube is scrapped after the rocket is fired. The bracket is preferably cast aluminum with a lusterless black or olive drab finish. The surfaces may be contoured to match the stress patterns present in normal use and to save weight and material according to practices well known in the art.

I claim:

1. An adaptive bracket for mounting a generally cylindrical night sight, on an antitank rocket launcher said sight having an external longitudinally extending mounting bar; said launcher having a tall flat hinged daysight which folds flat against the tube of the launcher between two longitudinally oriented grooved rails affixed to said tube to engage a slide-on protective cover for the daysight; said bracket comprising:

a first channel shaped portion having substantially the same dimensions and proportions as said cover, such that it will slide on said rails and cover said daysight;

a clamp means to lock said first portion to said rails and to prevent linear or angular displacement therebetween;

a second flange portion integral with and longitudinally coextensive along said first portion, said flange defining a groove to mate with said mounting bar; and a connection means mounted on said flange portion to lock said bar in said groove.

2. An adaptor according to claim 1, wherein:

said channel shaped portion comprises two elongated sections hinged about a longitudinal axis; and said clamp means comprises a screw threaded through one section and pressing on the other section.

3. An adapter according to claim 2 wherein:

said other section includes a rectangular leaf spring supported only by its opposite edges and said screw presses on the middle of said spring.

* * * * *